US007255415B2

(12) United States Patent
Shimamura

(10) Patent No.: US 7,255,415 B2
(45) Date of Patent: Aug. 14, 2007

(54) PRINTING APPARATUS AND PRINTING APPARATUS CONTROL METHOD

(75) Inventor: Yoshiyuki Shimamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 10/765,323

(22) Filed: Jan. 26, 2004

(65) Prior Publication Data

US 2004/0155918 A1 Aug. 12, 2004

(30) Foreign Application Priority Data

Jan. 31, 2003 (JP) ..... 2003-024320

(51) Int. Cl.
*B41J 29/393* (2006.01)

(52) U.S. Cl. ..... 347/19

(58) Field of Classification Search ..... 347/14, 347/19

See application file for complete search history.

(56) References Cited

U.S. PATENT DOCUMENTS 5,751,302 A * 5/1998 Rezanka ..... 347/9
5,847,726 A 12/1998 Hori ..... 347/23
6,067,101 A * 5/2000 Arakawa et al. ..... 347/19
6,109,724 A 8/2000 Takahashi et al. ..... 347/23
6,189,996 B1 2/2001 Shimamura et al. ..... 347/23
6,359,701 B1 * 3/2002 Yamada et al. ..... 358/1.2
6,464,317 B2 * 10/2002 Miyazawa ..... 347/14
6,652,063 B1 * 11/2003 Shimamura et al. ..... 347/23

FOREIGN PATENT DOCUMENTS

JP 3-234544 10/1991
JP 2001-232802 8/2001

OTHER PUBLICATIONS

English Abstract for Japanese Patent Application 2001-232802.
European Search Report dated Apr. 12, 2005.

* cited by examiner

*Primary Examiner*—Stephen Meier
*Assistant Examiner*—Jason Uhlenhake
(74) *Attorney, Agent, or Firm*—Morgan & Finnegan, LLP

(57) ABSTRACT

In a printing apparatus which must periodically execute maintenance operation after activation and has a timer that counts the time on the basis of power supplied from a battery and has a register in which a flag is written when an abnormality occurs in the battery, the internal time is so set as to be counted up on the basis of time read out from the timer. When the flag is written in the register upon activating the apparatus, information representing occurrence of the abnormality is written in a nonvolatile storage. Predetermined time is set as the internal time, the flag is cleared, and execution of maintenance operation is designated on the basis of the internal time.

5 Claims, 6 Drawing Sheets

PRINTING APPARATUS AND PRINTING APPARATUS CONTROL METHOD

FIELD OF THE INVENTION

The present invention relates to a printing apparatus and, more particularly, to time management in a printing apparatus which incorporates a timer and must be periodically maintained.

BACKGROUND OF THE INVENTION

A printing apparatus which prints information such as a desired character or image on a sheet-like printing medium such as a paper sheet or film is widely used as an information output apparatus in a word processor, personal computer, facsimile apparatus, and the like.

Various methods are known as printing methods adopted in the printing apparatus. Especially an inkjet method has recently received a great deal of attention because this method can realize noncontact printing on a printing medium such as a paper sheet, easily prints in color, and is quiet. Because of low cost and easy downsizing, a popular inkjet arrangement is a serial printing system in which a printhead for discharging ink in accordance with desired printing information is mounted and prints while the printhead is reciprocally scanned in a direction perpendicular to the convey direction of a printing medium such as a paper sheet.

In general, the inkjet printing apparatus clogs because ink attached to the discharge surface of the printhead thickens or dust attaches to the discharge surface upon the lapse of time. The inkjet printing apparatus must periodically receive recovery operation such as cleaning of the discharge surface of the printhead or suction of nozzles. For this purpose, the inkjet printing apparatus is generally configured to request a computer serving as a host device to transmit current time data, calculating the time elapsed after previous recovery operation on the basis of the received time data, and when the elapsed time exceeds a predetermined time, executing recovery operation (see, e.g., Japanese Patent Laid-Open No. 3-234544).

Along with the spread of digital cameras, camera-equipped cell phones, and the like, demands have recently arisen for printing data such as images stored in PDAs, cell phones, digital cameras, and the like. There is proposed a printing apparatus which is connected to such device to print. There is also proposed a printing apparatus which has a slot for inserting a storage medium such as a memory card and can print image data stored in the storage medium inserted into the slot.

When the host device is a computer, it can transmit current time data to a printing apparatus. When the host device is not a computer or image data stored in a storage medium inserted into a slot is to be printed, as described above, the printing apparatus must incorporate a timepiece means (timer) which counts the current time.

If the timer is incorporated, e.g., a coin type battery must be arranged to always operate the timer. Such battery has conventionally been soldered to the control board of the printing apparatus. Recently, an arrangement which allows easily removing a battery without disassembling the printing apparatus is required as measures for environmental issues and the like.

In the arrangement which allows easily removing a battery, if the user erroneously removes the battery or the printing apparatus is shocked, the battery may be temporarily electrically disconnected to stop power supply to the timer. In this case, the timer cannot accurately count the time, and the interval of recovery operation of the printhead is prolonged, degrading the printing image quality.

This problem is not limited to the inkjet printing apparatus, and is common to another type of printing apparatus whose printhead or printing portion must be periodically maintained.

SUMMARY OF THE INVENTION

The present invention has been made in consideration of the above situation, and has as its object to periodically execute maintenance even if power supply to a timer temporarily stops in a printing apparatus which incorporates the timer and must be periodically maintained.

To achieve the above object, according to one aspect of the present invention, there is provided a printing apparatus which needs to periodically execute maintenance operation after activation, comprising timer means, having a register in which a flag is written when an abnormality occurs in a battery, for counting time on the basis of power supplied from the battery, nonvolatile storage means, internal time counting means for counting up internal time on the basis of time read out from the timer means, timer abnormality processing means for, when the flag is written in the register upon activating the apparatus, writing information representing occurrence of the abnormality in the storage means, setting predetermined time as the internal time, clearing the flag, and setting the predetermined time in the timer means, and maintenance designation means for designating execution of the maintenance operation on the basis of the internal time.

More specifically, according to the present invention, in a printing apparatus which must periodically execute maintenance operation after activation and has timer means that counts the time on the basis of power supplied from a battery and has a register in which a flag is written when an abnormality occurs in the battery, the internal time is so set as to be counted up on the basis of time read out from the timer means. When the flag is written in the register upon activating the apparatus, information representing occurrence of the abnormality is written in nonvolatile storage means, and predetermined time is set as the internal time. The predetermined time is also set in the timer, the flag is cleared, and execution of maintenance operation is designated on the basis of the internal time.

With this arrangement, even when an abnormality occurs in the timer battery, the time elapsed upon activation is accurately counted on the basis of the internal time. Execution of maintenance operation is designated on the basis of the internal time.

Even if an abnormality occurs in the timer battery, maintenance operation upon activation is periodically executed at a predetermined interval. Information representing occurrence of the abnormality in the battery is stored in nonvolatile recording means. The internal time and timer can be reset to accurate time upon reception of accurate time information from a host computer or the like.

The apparatus may further comprise reset means for, when the information representing occurrence of the abnormality is written in the storage means upon reception of time information from a connected host device, setting the received time information as the internal time, clearing the information representing occurrence of the abnormality, and setting the predetermined time in the timer means.

The battery of the timer means may be attached to be easily removed externally.

The apparatus may comprise an inkjet printhead which discharges ink and prints, and the maintenance operation may include an operation of recovering discharge performance of the printhead.

In this case, the printhead may comprise a thermal transducer for generating thermal energy to be applied to the ink so as to discharge the ink by using the thermal energy.

In addition to the above aspect, the present invention can also be realized as the aspects of a printing apparatus control method corresponding to the above printing apparatus, a computer program which realizes the control method, and a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiment of the present invention will now be described in detail in accordance with the accompanying drawings.

In the following embodiment, a printer utilizing an inkjet printing system is explained as an example of a printing apparatus.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Figure 4:
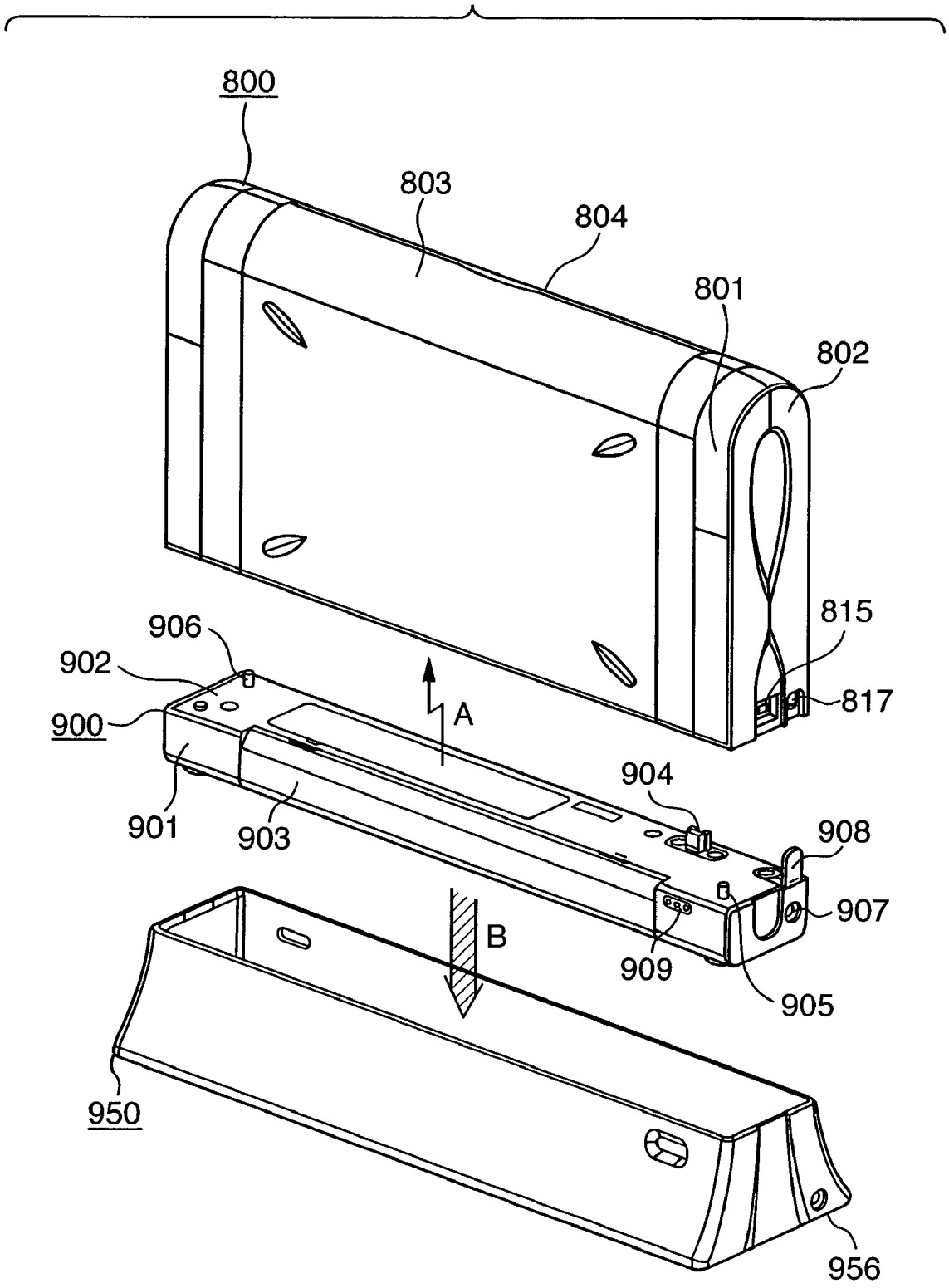
FIG. 4 is a perspective view showing the overall arrangement of the inkjet printer according to the embodiment of the present invention.

FIG. 4 is a perspective view showing the overall arrangement of a printing apparatus according to an embodiment of the present invention. FIG. 4 shows an inkjet printer serving as a printing apparatus, a battery charger serving as a charging device which incorporates a battery and is detachable from the printer main body, and a cradle serving as a mount for vertically housing the printer and battery charger while attaching them. A paper sheet will be exemplified as a printing medium for printing by the inkjet printer. The present invention is not limited to this, and can be applied to any printable sheet-like medium.

In FIG. 4, the outer appearance of an inkjet printer 800 is an integral shell structure comprised of an upper case 801, lower case 802, feed cover 803, and feed port cover 804. The inkjet printer 800 takes this form when it is not used (stands still or is carried). The side surface of the inkjet printer 800 has a "DC in" jack (DC power input jack) 817 for inserting an AC adopter cable serving as a power supply, and an I/F connector (interface connector) 815 for connecting a USB cable. The feed cover 803 is a printing sheet supply tray which is opened from the printer main body to support a printing sheet such as a paper sheet in printing.

The outer appearance of a battery charger 900 is comprised of a main case 901, cover case 902, and battery lid 903. The battery lid 903 is detached to open the main case 901, allowing removing a battery pack serving as a battery charger.

The mounting surface (connection surface) of the battery charger 900 to the inkjet printer 800 has a main body connector 904 for electrical connection, and fixing screws 905 and 906 for mechanical attachment and fixing. The battery charger 900 is connected to the printer main body in a direction indicated by an arrow A in FIG. 4 to drive the printer by the battery. The top surface of the battery charger 900 has a charge indicator 909 which indicates the charging state of the battery. The side surface of the battery charger 900 has a "CHG-DC in" jack 907 for inserting an AC adopter cable serving as a power supply, and a cover plate 908 for covering the "DC in" jack 817 of the inkjet printer 800 when the battery charger 900 is attached.

A cradle 950 functions as a mount by inserting it in a direction indicated by an arrow B in FIG. 4 while the battery charger 900 is attached to the inkjet printer 800.

Figure 5:
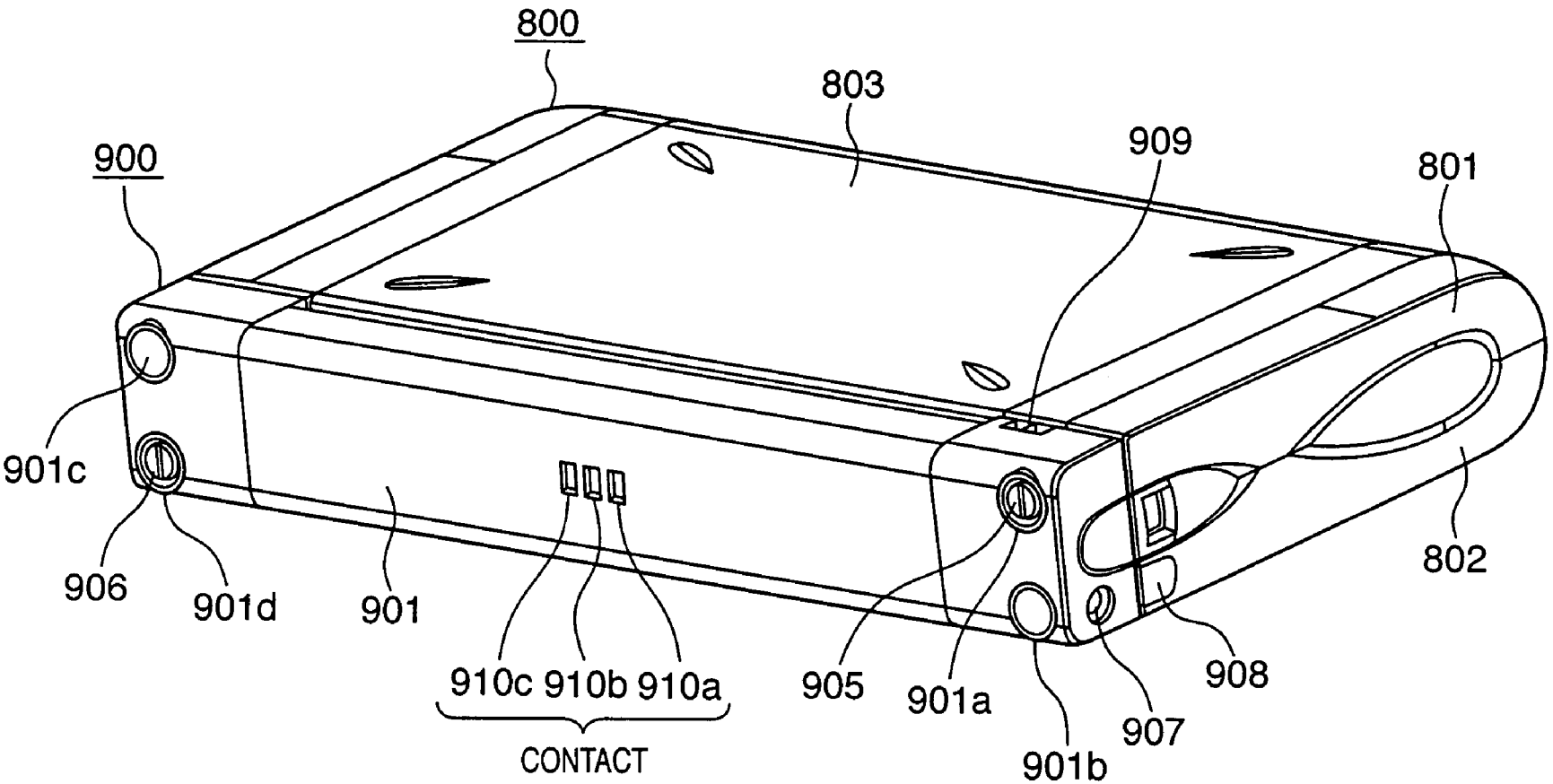
FIG. 5 is a perspective view showing a state in which a battery charger is mounted on the inkjet printer shown in FIG. 4.

FIG. 5 is a perspective view showing a state in which the battery charger 900 is mounted on the inkjet printer 800 when the printer back surface and printer top surface are viewed diagonally from the top.

As shown in FIG. 5, the battery charger 900 is attached to the back surface of the inkjet printer 800, and fixed with the fixing screws 905 and 906 to implement a battery-driven printer.

As described above, the "DC in" jack 817 of the inkjet printer 800 is covered with the cover plate 908 of the battery charger 900. In attaching the battery charger 900, the user reliably inserts the AC adopter cable to the "CHG-DC in" jack 907 of the battery charger 900, thus preventing erroneous insertion.

The back surface of the battery charger 900 has four legs 901*a*, 901*b*, 901*c*, and 901*d* on the main case 901. This back surface also has contacts 910*a*, 910*b*, and 910*c* for electrical contact upon attachment to the cradle 950.

As shown in FIG. 5, the charge indicator 909 of the battery charger 900 is arranged at a position where, even when the feed cover 803 is opened, the feed cover 803 does not interrupt visual recognition on the top surface on which the charge indicator 909 can be easily visually recognized in mounting or using the inkjet printer 800.

Figure 6:
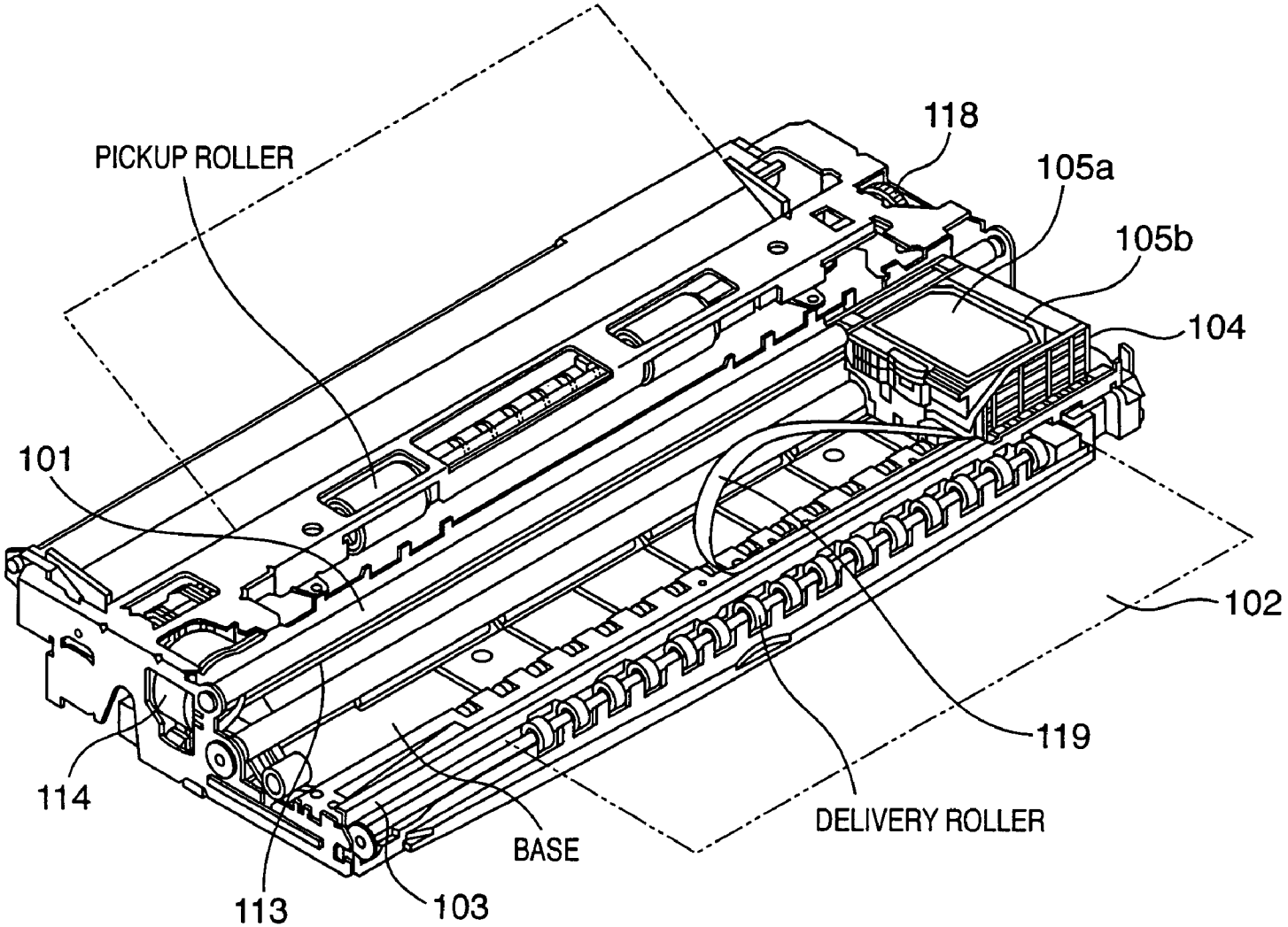
FIG. 6 is a perspective view showing the schematic arrangement of the inkjet printer in FIG. 4.

FIG. 6 is a perspective view showing an arrangement concerning printing in the printing apparatus according to the embodiment. Reference numeral 105*b* denotes a printhead and 105*a* denotes an ink tank which supplies ink to the printhead 105*b*, and the printhead 105*b* and the ink tank 105*a* constitute a printhead cartridge. The printhead cartridge is detachably mounted on a carriage 104, and can reciprocally move in a longitudinal direction along a scanning guide 103. Ink discharged from the printhead reaches a printing medium 102 whose printing surface is regulated by a platen 101 at a small interval from the printhead. The ink forms an image on the printing medium 102.

The printhead receives a discharge signal via a flexible cable 119 in accordance with image data. Reference numeral 114 denotes a carriage motor for scanning the carriage 104 along the scanning guide 103. Reference numeral 113 denotes a wire which transmits the driving force of the motor 114 to the carriage 104. Reference numeral 118 denotes a convey motor which is coupled to the platen roller 101 to convey the printing medium 102.

Figure 3:
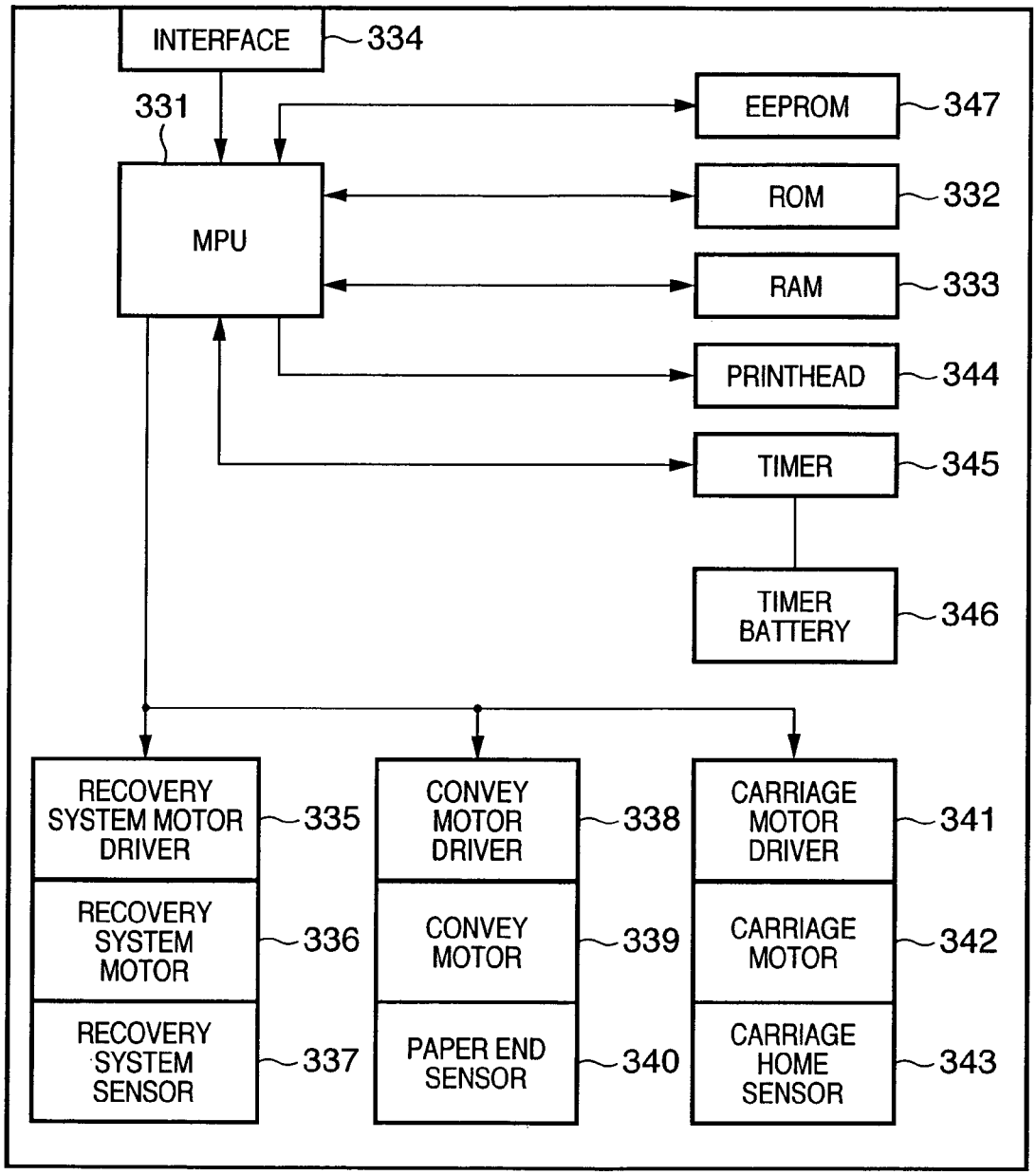
FIG. 3 is a block diagram showing the control arrangement of an inkjet printer according to the embodiment of the present invention.

FIG. 3 is a block diagram showing the control arrangement of the printing apparatus according to the embodiment.

Reference numeral 331 denotes a microprocessor unit (MPU); 332, a ROM which stores the control program of the printing apparatus and a table representing the relationship between the file extension, the paper size, and the printing mode; and 333, a RAM which is used as a work area in executing a program and stores file data and internal time data (to be described later).

The MPU 331 supplies driving pulses to a convey motor driver 338, carriage motor driver 341, and recovery system motor driver 335, and controls a convey motor 339, carriage motor 342, and recovery system motor 336 while confirming the presence/absence of a printing sheet, the carriage position, and the state of a recovery system unit by a paper end sensor 340, carriage home sensor 343, and recovery system sensor 337. The MPU 331 receives via an interface 334 a file to be printed, a print instruction, and print data from a host device (not shown) such as a computer or portable electronic device. Reference numeral 344 denotes a printhead which is controlled by the MPU 331 to discharge ink and print in accordance with print data.

Reference numeral 345 denotes a timer which counts the time, is controlled by the MPU 331, and reads out and sets the time. Reference numeral 346 denotes a timer battery which operates the timer 345 even if the printing apparatus is not powered on. The timer 345 has a function of detecting a power abnormality from, e.g., the voltage value between two power terminals. If a power abnormality is detected, a power abnormal flag in the internal register of the timer is set. In this example, the battery 346 is used as the power supply of the timer, and the flag represents the abnormality of the battery 346.

The printing apparatus according to the embodiment comprises an EEPROM 347 as an electrically programmable nonvolatile storage medium which is accessed by the MPU 331. When a battery abnormality is detected, a flag representing a timer abnormality is set in a specific area of the EEPROM 347.

Processing upon activating the printing apparatus according to the embodiment will be explained with reference to the flow chart of FIG. 1.

If the printing apparatus is powered on, the state of the register in the timer is read out to check the timer state (step S101). Whether a battery abnormality has occurred in the timer is determined from the register state (step S102). If NO in step S102, the current time is read out from the timer (step S103). The read current time is set in an area for storing the internal time in the RAM 333 of the printing apparatus (step S104). The timer is so set as to count up the internal time by an interruption every second (step S108).

If YES in step S102, a flag representing a timer abnormality is set in the EEPROM 347 of the printing apparatus (step S105). Given fixed time is set in the timer, and a flag representing a battery abnormality in the register of the timer is deleted (cleared) (step S106). The fixed time set in step S106 is set in the area for storing the internal time in the RAM of the printing apparatus so as to synchronize with the timer (step S107).

The timer starts operating on the basis of the fixed time set in step S106, and is so set as to count up the internal time by an interruption every second (step S108).

The fixed time set in step S106 may be specific time such as Jan. 1, 2000. Alternatively, the time when software in the printing apparatus designates power-off may be written in the EEPROM each time, and the time may be read out from the EEPROM and written in the timer.

The flag representing a battery abnormality in the register of the timer is deleted in step S106 in order not to perform the same processing again when the printing apparatus is powered on next time. If, however, the battery abnormality of the timer is detected again upon next activation and the flag representing a battery abnormality in the register of the timer is set, the processing of this flow chart must be executed again.

Figure 2:
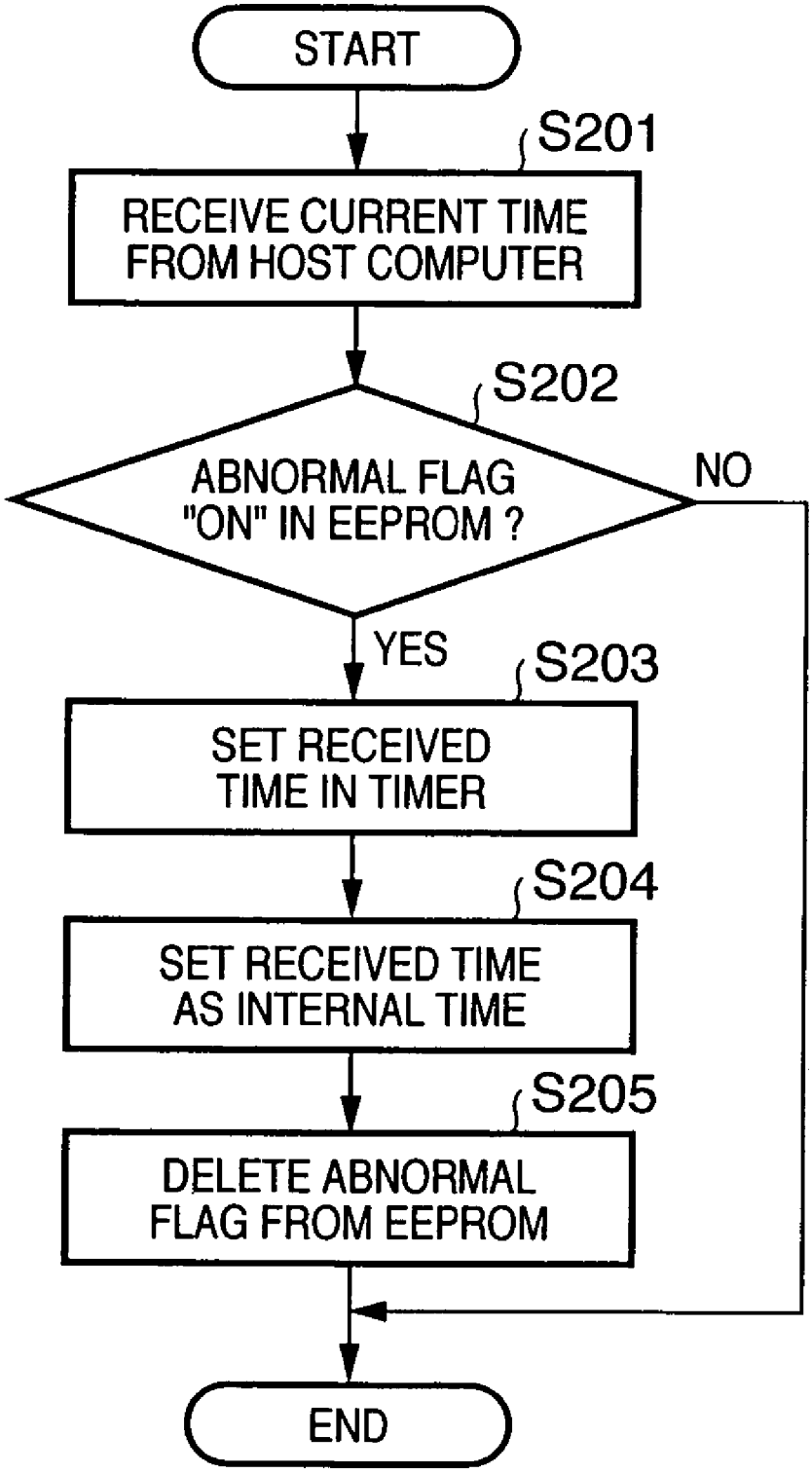
FIG. 2 is a flow chart showing current time setting processing according to the embodiment of the present invention.

Time setting processing executed in the printing apparatus according to the embodiment will be explained with reference to the flow chart of FIG. 2.

Current time data transmitted from a host computer is received via the interface (step S201). Transmission of current time data is one of functions assembled in a printer driver installed in the host computer. This function is executed when the printing apparatus in a standby state is connected to the host computer.

Figure 1:
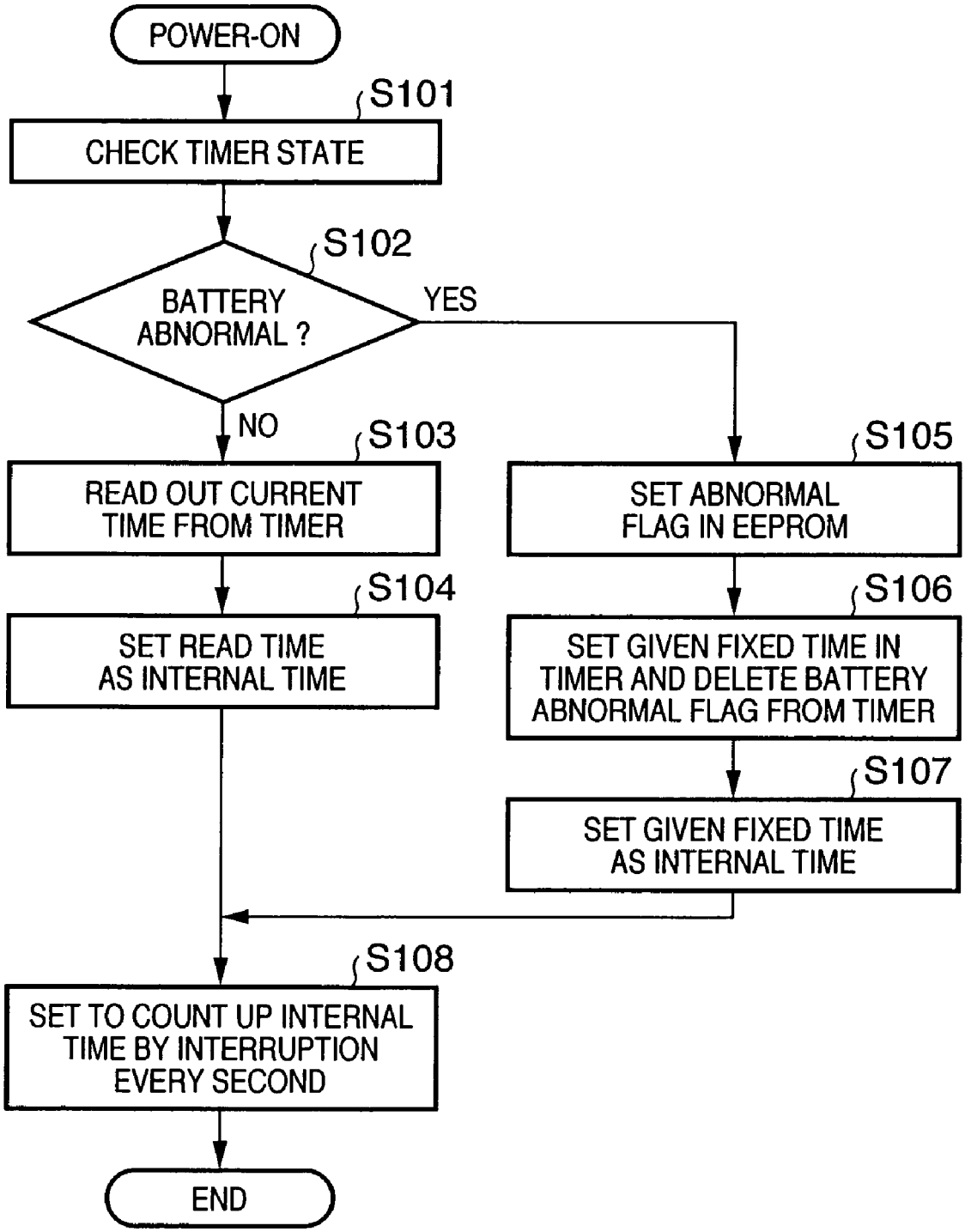
FIG. 1 is a flow chart showing processing upon activation according to an embodiment of the present invention.

Whether the flag representing a timer abnormality in the EEPROM 347, which has been described in relation to step S105 of the flow chart in FIG. 1, has been set is determined (step S202). If NO in step S202, processing ends without any operation; if YES, the time received from the host computer is set in the timer (step S203). The internal time in the RAM of the printing apparatus is set to the same time as that set in the timer (step S204). The flag representing a timer abnormality in the EEPROM is cleared.

As described above, according to the embodiment, when an abnormality occurs in the timer battery and a device such as a personal computer capable of transmitting time information in accordance with a predetermined protocol is connected as a host device, accurate time can be automatically set without any involvement of the user.

Also when a device such as a PDA, cell phone, or digital camera which cannot transmit time information is connected as a host device, the elapsed time can be obtained from the internal time, and the printhead can be reliably maintained.

Other Embodiments

The present invention can be applied to a system comprising a plurality of devices or to an apparatus comprising a single device.

Furthermore, the invention can be implemented by supplying a software program, which implements the functions of the foregoing embodiments (corresponding to the flowcharts shown in FIGS. 1 and 2), directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

What is claimed is:

1. A method of controlling a printing apparatus which needs to periodically execute maintenance operation after activation, said printing apparatus having a timer for counting time on the basis of an internal time, where the timer is operated by power supplied from a local battery and configured to set an internal flag when a power failure of the local battery has occurred, the method comprising:

setting the internal flag in a register of the timer when a a power failure has occurred in the local battery of the timer;

reading the internal flag to determine whether the power failure has occurred based on the status of the internal flag set in said setting the internal flag step;

setting an updated time as the internal time when the power failure has occurred based on the result from said determining step where the updated time reflects correction from an error caused by the power failure of the local battery;

designating execution of a maintenance operation on the basis of the internal time set in said setting an updated time step; and clearing the flag after setting the new time at said setting an updated time step.

2. The method according to claim 1, wherein said setting an updated time step sets the internal time based on time information transmitted from a host device.

3. The method according to claim 1, wherein said setting an updated time step sets the internal time based on an elapsed time from the timer.

4. The method according to claim 2, wherein the host device is a personal computer.

5. The method according to claim 2, wherein the host device is either one of a PDA, a cellular phone or a digital camera.

* * * * *